US010793993B2

(12) United States Patent
Yang et al.

(10) Patent No.: US 10,793,993 B2
(45) Date of Patent: Oct. 6, 2020

(54) DEVICE AND METHOD FOR CONTROLLING AUTOMATIC OPENING AND CLOSING OF UPPER COVER OF WASHING MACHINE

(71) Applicant: QINGDAO HAIER WASHING MACHINE CO., LTD., Shandong (CN)

(72) Inventors: Lin Yang, Shandong (CN); Mingyan Shao, Shandong (CN); Wenting Xu, Shandong (CN); Futao Xing, Shandong (CN)

(73) Assignee: Qingdao Haier Washing Machine Co., Ltd., Shandong (CN)

( * ) Notice: Subject to any disclaimer, the term of this patent is extended or adjusted under 35 U.S.C. 154(b) by 232 days.

(21) Appl. No.: 16/075,130

(22) PCT Filed: Jan. 26, 2017

(86) PCT No.: PCT/CN2017/072737

§ 371 (c)(1),
(2) Date: Aug. 2, 2018

(87) PCT Pub. No.: WO2017/133637

PCT Pub. Date: Aug. 10, 2017

(65) Prior Publication Data

US 2019/0071816 A1 Mar. 7, 2019

(30) Foreign Application Priority Data

Feb. 2, 2016 (CN) ..... 2016 1 0072731

(51) Int. Cl.
*D06F 39/14* (2006.01)
*D06F 34/18* (2020.01)
(Continued)

(52) U.S. Cl.
CPC ..... *D06F 39/14* (2013.01); *D06F 34/18* (2020.02); *D06F 34/28* (2020.02); *D06F 23/04* (2013.01);
(Continued)

(58) Field of Classification Search
CPC ..... D06F 39/14
See application file for complete search history.

(56) References Cited

FOREIGN PATENT DOCUMENTS

CN 1158924 A 9/1997
CN 204570292 U 8/2015
(Continued)

OTHER PUBLICATIONS

International Search Report and Written Opinion dated May 9, 2017, regarding PCT/CN2017/072737.

*Primary Examiner* — Jason Y Ko
(74) *Attorney, Agent, or Firm* — Arent Fox LLP

(57) ABSTRACT

Provided are a device and a method for controlling automatic opening and closing of an upper cover of a washing machine. The device includes a controller and a detector. The controller is configured to control a motor to rotate to drive the upper cover to open, close or stop at a current position. The detector is connected to the controller and is configured to collect a signal indicating an obstacle between the upper cover and a tray or on one side of the upper cover facing away from the tray, and send the signal indicating the obstacle to the controller. When the existence of the obstacle between the upper cover and the tray or on the one side of the upper cover facing away from the tray is determined, the controller controls the upper cover to stop at the current position or return to an initial position.

20 Claims, 5 Drawing Sheets

(51) Int. Cl.

| | |
|---|---|
| ***D06F 34/28*** | (2020.01) |
| *D06F 23/04* | (2006.01) |
| *D06F 33/00* | (2020.01) |

(52) U.S. Cl.
CPC ..... *D06F 33/00* (2013.01); *D06F 2202/12* (2013.01); *D06F 2204/06* (2013.01); *D06F 2204/10* (2013.01); *D06F 2224/00* (2013.01)

(56) References Cited

FOREIGN PATENT DOCUMENTS

| | | | |
|---|---|---|---|
| CN | 105063957 | A | 11/2015 |
| CN | 105063958 | A | 11/2015 |
| CN | 204899474 | U | 12/2015 |
| CN | 204959362 | U | 1/2016 |
| JP | H09164291 | A | 6/1997 |
| JP | 2004238893 | A | 8/2004 |
| JP | 2006273189 | A | 10/2006 |

DEVICE AND METHOD FOR CONTROLLING AUTOMATIC OPENING AND CLOSING OF UPPER COVER OF WASHING MACHINE

CROSS REFERENCE TO RELATED APPLICATIONS

This is a National Stage Application, filed under 35 U.S.C. 371, of International Patent Application No. PCT/CN2017/072737, filed on Jan. 26, 2017, which claims priority to Chinese patent application No. 201610072731.6 filed on Feb. 2, 2016, contents of both of which are incorporated herein by reference in their entireties.

TECHNICAL FIELD

The present disclosure relates to a washing machine control field, for example, relates to a device and a method for controlling automatic opening and closing of an upper cover of a washing machine.

BACKGROUND

Modes of opening or closing an upper cover of a washing machine include an automatic mode and a manual mode. In the automatic mode, a motor is used to drive the upper cover to open or close, protection measures are lacking in the closing process of the upper cover, and if fingers or other parts of a user are placed between a tray and the upper cover of the washing machine when the upper cover is closed, it is very likely to pinch the finger or the arm of the user, causing personal injury to the user.

If the upper cover is continuously opened or closed in an automatic mode when an obstacle exits on the upper cover of the washing machine or between the upper cover and the tray, the motor will be blocked when the motor encounters the obstacle. Then, a current of the coil in the motor becomes larger, and the motor may be burnt if the obstacle is not removed in time.

SUMMARY

The disclosure provides a device and method for controlling automatic opening and closing of an upper cover of a washing machine, which prevent the user from being pinched when the upper cover is closed and the motor from being burnt when the obstacle is not removed in time during the opening or closing process of the upper cover.

A device for controlling automatic opening and closing of an upper cover of a washing machine includes a controller and a detector. The controller is configured to control the motor to rotate to drive the upper cover connected to the motor to open, close or stop at a current position. The detector is connected to the controller and is configured to collect a signal indicating an obstacle between the upper cover and the tray or on one side of the upper cover facing away from the tray, and send the signal indicating the obstacle to the controller. When determining the existence of the obstacle between the upper cover and the tray or on the one side of the upper cover facing away from the tray according to the signal indicating the obstacle, the controller controls the upper cover to stop at the current position or returns to an initial position.

In one embodiment, the controller is configured to control the motor to rotate clockwise, rotate counterclockwise or stop to drive the upper cover to open, close or stop at the current position respectively.

In one embodiment, the signal indicating the obstacle is a current signal of a coil in the motor during rotation of the motor.

In one embodiment, the device can further include an alarm device connected to the controller.

In one embodiment, the device can further include an angle measuring device connected to the controller.

A method for controlling automatic opening and closing of an upper cover of a washing machine includes the following:

S10: controlling the motor to drive the upper cover to open or close by the controller. S20: collecting a signal indicating an obstacle between the upper cover and the tray or on one side of the upper cover facing away from the tray by the detector, and sending the signal indicating the obstacle to the controller by the detector. S30: receiving the signal indicating the obstacle by the controller, determining, by the controller, whether the obstacle between the upper cover and the tray or on the one side of the upper cover facing away from the tray exists according to the signal indicating the obstacle. S40: when an existence of the obstacle between the upper cover and the tray or on the one side of the upper cover facing away from the tray is determined by the controller, controlling, by the controller, the motor to drive the upper cover to stop at the current position or return to the initial position and performing S50; when a non-existence of the obstacle between the upper cover and the tray or on the one side of the upper cover facing away from the tray is determined by the controller, controlling, by the controller, the motor to drive the upper cover to be continuously opened or closed until the upper cover is fully opened or closed. S50: performing operations in S10 to S40 after the upper cover stops at the current position or returns to the initial position for a duration T.

In one embodiment, in S20, the detector collects the current signal of the coil in the motor during rotation of the motor as the signal indicating the obstacle.

In one embodiment, in S30, the controller receives the current signal, calculates the corresponding current value I, and determine an existence of an obstacle between the upper cover and the tray or on the one side of the upper cover facing away from the tray when the current value I is greater than preset current value $I_a$.

In one embodiment, in S40, after the controller determines the existence of the obstacle between the upper cover and the tray or on the one side of the upper cover facing away from the tray, the method can further include: sending an alarm by the alarm device to remind the user to remove the obstacle.

In one embodiment, before S10, the method can further include: manually opening or closing the upper cover, collecting an angle A between the upper cover and the tray in real time by the angle measuring device, and sending the angle A to the controller; and receiving, by the controller, the angle A sent by the angle measuring device, determining, by the controller, an angle β at which the upper cover currently opens or closes according to the angle A, comparing, by the controller, the angle β with a preset angle α to obtain a comparison result, and determining, by the controller whether to control the motor to drive the upper cover to be automatically opened or closed according to the comparison result.

In one embodiment, when the angle β is greater than the preset angle α, the controller controls the motor to drive the upper cover to open or close automatically.

In one embodiment, the preset angle α is in a range of 0°-30°.

A non-transitory computer-readable storage medium, which is configured to store computer-executable instructions for performing the method for controlling automatic opening and closing of an upper cover of a washing machine.

A device includes one or more controllers, a memory, and one or more programs that are stored in the memory. When the one or more programs are executed by the one or more controllers, any method for controlling automatic opening and closing of an upper cover of a washing machine described above is performed.

Through analyzing the changes of the current of the coil in the motor which drives the upper cover to move, it can be determined whether an obstacle exists between the upper cover and the tray or on one side of the upper cover facing away from the tray, which can prevent the user from being pinched accidently when the upper cover is closed and the motor from being burnt when it is blocked by the obstacle for a long time during the automatic opening and closing process of the upper cover. The disclosure further provides a method of a combination of a manual mode with an automatic mode to open or close an upper cover. When the function of automatically opening or closing the upper cover is enabled, the user is reminded to remove the finger, which can reduce the possibility of pinching the user and save the force used when the upper cover is opened or closed manually.

1: Controller; 2: Detector; 3: Motor; 4: Upper cover; 5: Alarm; 6: Angle measuring device.

DETAILED DESCRIPTION

The solution of the present disclosure is further described in conjunction with the following embodiments and drawings. It should be understood that the embodiments described herein are intended to explain and not to limit the present disclosure. If not in collision, the embodiments described herein and the features thereof may be combined with each other.

Figure 1:
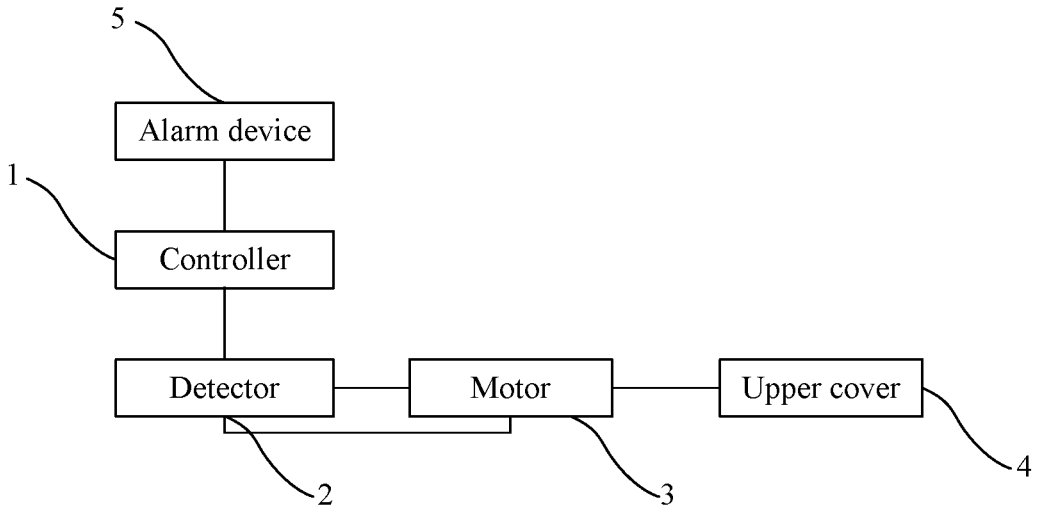
FIG. 1 is a structural diagram of a device for controlling automatic opening and closing of an upper cover of a washing machine according to various embodiments.

The embodiment illustrated in FIG. 1 provides a device for controlling automatic opening and closing of an upper cover of a washing machine. As shown in FIG. 1, the control device may include a controller 1 and a detector 2 connected to the controller 1.

The controller 1 controls a motor 3 to rotate clockwise, rotate counterclockwise or stop to drive an upper cover 4 to open, close or stop at a current position.

The detector 2 is configured to collect a signal indicating an obstacle between the upper cover 4 and a tray or on one side of the upper cover 4 facing away from the tray during the opening or closing process of the upper cover 4, and send the signal indicating the obstacle to the controller 1.

In one embodiment, the signal indicating the obstacle can be a current signal of a coil in the motor 3 during rotation of the motor 3. When the upper cover 4 encounters an obstacle during the opening or closing process, the motor 3 will be blocked, which leads to changes in the current of the coil in the motor 3. The detector 2 collects the current signal of the coil in the motor 3, and sends the collected current signal to the controller 1. The controller 1 calculates the change of the electrical current value I to determine whether the upper cover 4 encounters an obstacle during the opening or closing process according to the received current signal, and controls the upper cover 4 to stop at a current position or return to an initial position when the existence of the obstacle is determined.

In one embodiment, the device for controlling automatic opening and closing of an upper cover of a washing machine can further include an alarm device 5 connected to the controller 1. When the existence of the obstacle in the opening or closing process of the upper cover 4 is determined by the controller 1, the alarm device 5 reports an alarm device to remind the user to remove the obstacle.

Figure 2:
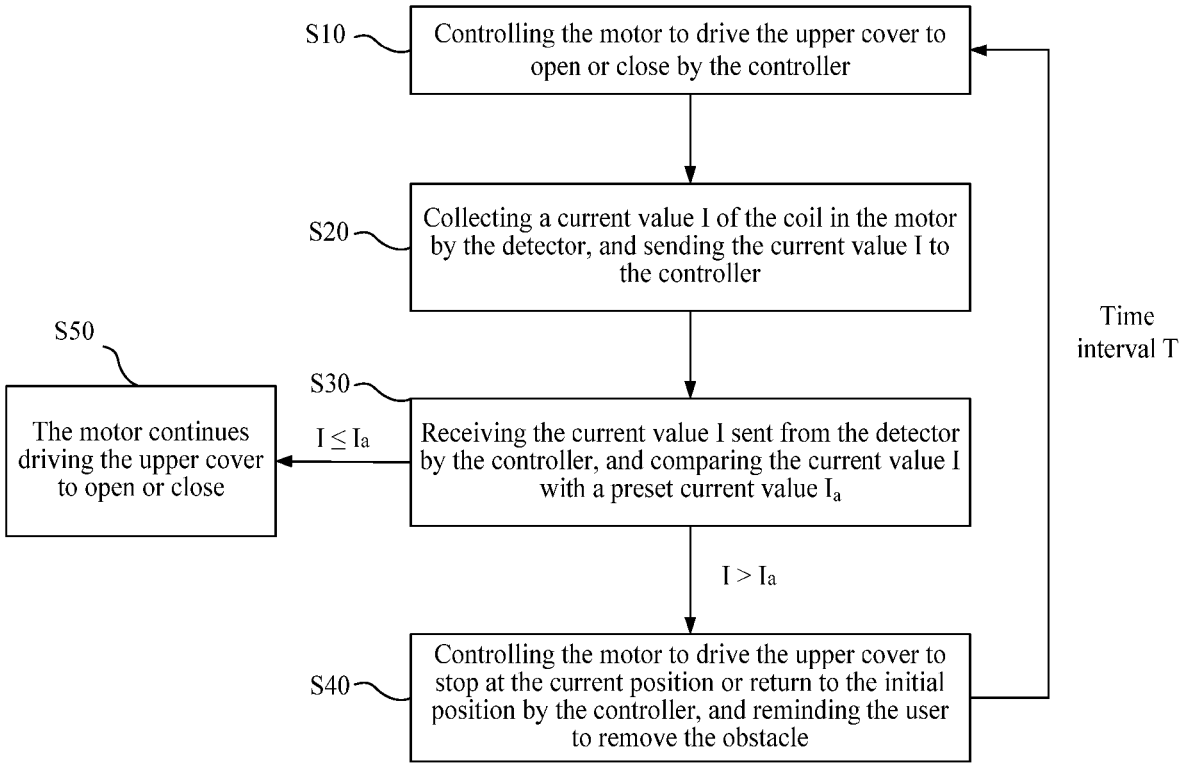
FIG. 2 is a flowchart of a method for controlling automatic opening and closing of an upper cover of a washing machine according to various embodiments.

Based on the above-mentioned device for controlling automatic opening and closing of an upper cover of a washing machine, the present embodiment further provides a method for controlling automatic opening and closing of an upper cover of a washing machine. As shown in FIG. 2, the control method includes the following:

In S10, controlling the motor 3 to drive the upper cover 4 to open or close by the controller 1.

In one embodiment, when the controller 1 controls the motor 3 to rotate clockwise, the motor 3 drives the upper cover 4 to open. When the controller 1 controls the motor 3 to rotate counterclockwise, the motor 3 drives the upper cover 4 to close. When the controller 1 controls the motor 3 to stop, the motor 3 drives the upper cover 4 to stop at the current position. When it is necessary to open or close the upper cover 4, the controller 1 sends a command signal to the motor 3 to control the motor 3 to rotate clockwise or counterclockwise so that the motor 3 drives the upper cover 4 to open or close automatically. The above is merely an example to illustrate the relationship between the rotation of the motor 3 and the movement of upper cover 4. In addition, when the controller 1 controls the motor 3 to rotate clockwise, the motor 3 can further drive the upper cover 4 to close. When the controller 1 controls the motor 3 to rotate counterclockwise, the motor 3 can further drive the upper cover 4 to open.

In S20, collecting a signal indicating an obstacle between the upper cover 4 and the tray or on one side of the upper cover 4 facing away from the tray by the detector 2, and sending the signal indicating the obstacle to the controller 1 by the detector 2.

In one embodiment, the signal indicating the obstacle may be the current value I of the coil in the motor 3 during rotation of the motor 3. The detector 2 collects the current signal of the coil in the motor 3 during rotation of the motor 3, and sends the detected current signal to the controller 1. Then the controller 1 processes the data of the current signal.

In S30, receiving the signal indicating the obstacle by the controller 1, and determining, by the controller 1, whether an obstacle between the upper cover 4 and the tray or on one side of the upper cover facing away from the tray exists.

The controller 1 receives the current signal and calculates the corresponding current value I, and compares the current value I with a preset current value $I_a$. The preset current value $I_a$ may be the current value of the coil in the motor 3 during the normal closing or opening process of the upper cover 4. When the upper cover 4 encounters an obstacle during the opening or closing process, the motor 3 will be blocked, leading to a larger current value of the coil in the motor 3. Therefore, if $I>I_a$, an obstacle exists during the opening or closing process of the upper cover 4. If $I\leq I_a$, no obstacle exists during the opening or closing process of the upper cover 4.

In S40, when the existence of an obstacle during the opening or closing process of the upper cover 4 is determined by the controller 1, controlling the motor 3 to drive the upper cover 4 to stop at the current position or return to the initial position by the controller 1 and performing S50, when a non-existence of the obstacle during the opening or closing process of the upper cover 4 is determined by the controller 1, controlling the motor 3 to drive the upper cover 4 to be continuously opened or closed until it is fully opened or closed.

When the existence of an obstacle during the opening or closing process of the upper cover 4 is determined, the controller 1 controls the motor 3 to drive the upper cover 4 to stop at the current position or return to the initial position. In one embodiment, when determining that an obstacle exists in the opening or closing process of the upper cover 4, the controller 1 controls the motor 3 to drive the upper cover 4 to stop at the current position. In one embodiment, when determining that an obstacle exists in the opening or closing process of the upper cover 4, the controller 1 controls the motor 3 to drive the upper cover 4 to stop at the current position and sends the command signal to the alarm device 5 at the same time, and the alarm device 5 reports an alarm device to remind the user to remove the obstacle, thus preventing the motor 3 from being burnt for being blocked continuously in the continued opening or closing process of the upper cover 4 and the user from being pinched in the continued closing process of the upper cover 4.

In one embodiment, an alarm sent from the alarm device 5 may be a sound alarm.

In S50, performing operations from S10 to S40 after the upper cover 4 stops at the current position or returns to the initial position for a duration T.

Certain time should be given to the user to remove the obstacle, and then the upper cover 4 is continuously opened or closed and the operations in S10 to S40 are repeated until the upper cover 4 is fully opened or closed. When confirming that an obstacle exists in the opening or closing process of the upper cover 4, the controller 1 controls the motor 3 to drive the upper cover 4 to stop at the current position, and since it takes a duration $T_1$ for the upper cover 4 to return from the current position to the initial position and return to the current position again, it should be guaranteed that T is greater than or equal to $T_1$.

Figure 3:
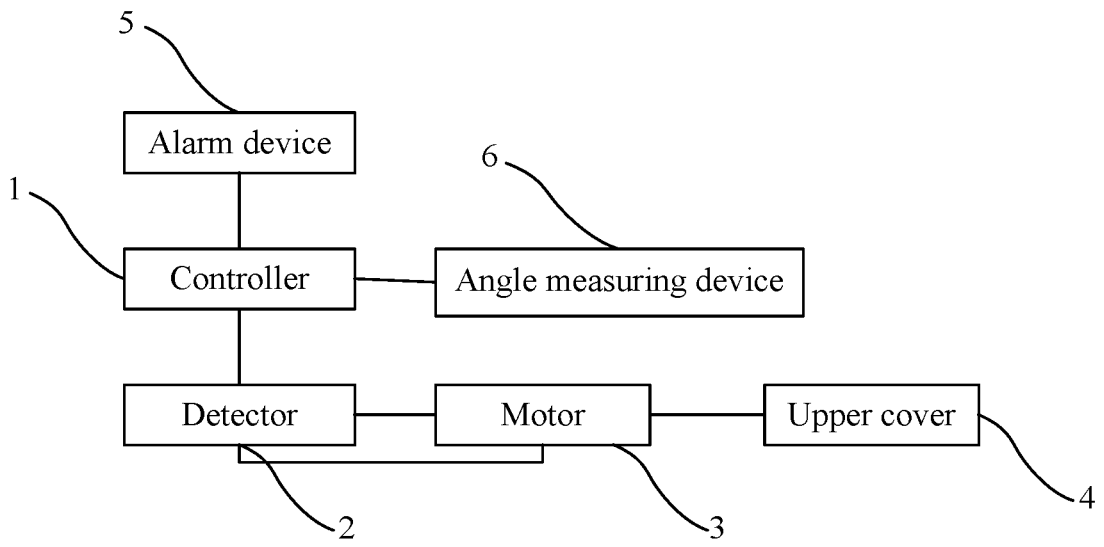
FIG. 3 is a structural diagram of a device for controlling automatic opening and closing of an upper cover of a washing machine according to various embodiments.
Figure 4:
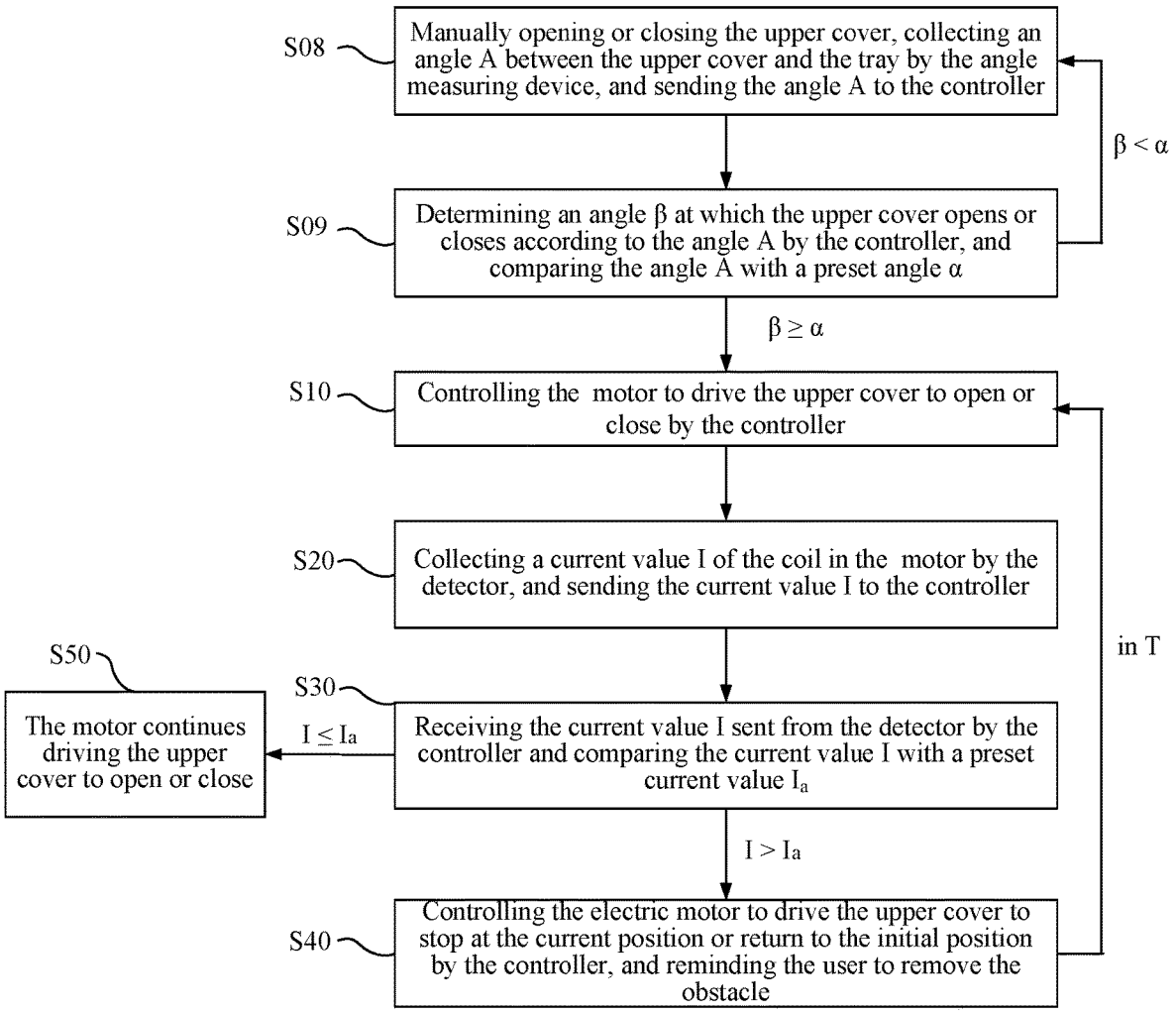
FIG. 4 is a flowchart of a method for controlling automatic opening and closing of an upper cover of a washing machine according to various embodiments.

On the basis of the embodiment of FIGS. 1 and 2, the device may further include an angle measuring device 6 as shown in FIG. 3, and a method as shown in FIG. 4 for controlling automatic opening and closing of an upper cover of a washing machine may further include manually opening or closing an upper cover 4 before operations in S10 are performed.

As shown in FIGS. 3 and 4, the angle measuring device 6 is connected to the controller 1. In S08, the controller 1 is configured to collect an angle A between an upper cover 4 and a tray in real time, and send the collected angle A to the controller 1. The controller 1 receives and deals with the angle A sent by the angle measuring device 6.

An angle at which the upper cover 4 opens or closes is set to β. When the upper cover 4 is opened, the angle A between the upper cover 4 and the tray is an angle β at which the upper cover 4 opens, that is, β equals A. When the upper cover 4 is closed, β at which the upper cover 4 closes equals to 90°−A.

In S09, the controller 1 calculates the angle β at which the upper cover 4 currently opens or closes, compares β with a preset angle α, and determines whether to control the motor 3 to drive the upper cover 4 to open or close automatically according to the comparison result. The preset angle α can be any value in a range of 0°-90°. In one embodiment, the preset angle α is in a range of 0°-30°, for example, any value in a range of 0°-15°.

In this embodiment, when β is greater than or equal to α, the controller 1 controls the motor 3 to drive the upper cover 4 to open or close automatically. When β is smaller than α, the upper cover 4 continues being opened or closed manually. The upper cover 4 can continue opening or closing automatically at a certain angle it opens by using the above-mentioned method. When the function of automatically opening or closing the upper cover is enabled, the alarm device reminds the user to remove the finger, which can reduce the possibility of pinching the user and save the force used when the upper cover 4 is opened or closed manually.

Various embodiments can provide a non-transitory computer-readable storage medium, which is configured to store computer-executable instructions for performing any method for controlling automatic opening and closing of an upper cover of a washing machine described above.

Figure 5:
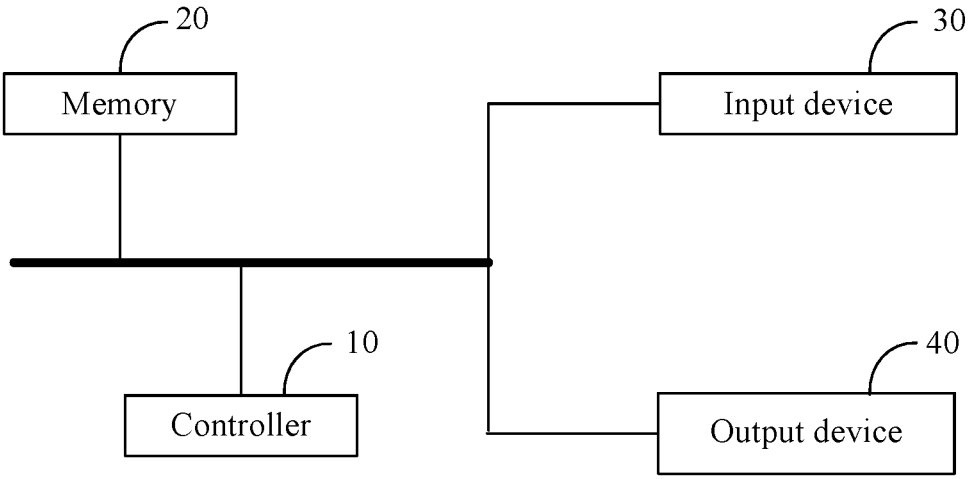
FIG. 5 is a diagram showing hardware structures of a device according to various embodiments.

Various embodiments can provide a device. FIG. 5 is a diagram showing hardware structures of the device. As shown in FIG. 5, the device may include one or more controllers 10 and a memory 20. One controller is taken as an example in the FIG. 5.

This device may further include an input device 30 and an output device 40.

The controller 10, the memory 20, the input device 30 and the output device 40 of the device may be connected by a bus or other means. Bus connection is taken as an example in FIG. 5.

As a non-transitory computer-readable storage medium, the memory 20 can be used for storing software programs, computer-executable programs and modules. The controller 10 performs different functional applications and data processing by executing software programs, instructions and modules stored in the memory 20, thereby implementing any method for controlling automatic opening and closing of an upper cover of a washing machine described above. For example, the controller 10 can control a motor 3 to rotate, receive a signal indicating an obstacle sent by a detector 2 and analyze the signal indicating the obstacle to determine whether an obstacle exists between an upper cover 4 and a tray or on one side of the upper cover 4 facing away from the tray, and receive an angle A sent by the angle measuring device 6 and analyze the angle A to determine whether to control the motor 3 to drive the upper cover 4 to open or close automatically.

The memory 20 may include a storage program area and a storage data area. The storage program area can store Operating System (OS) and application programs needed by at least one function. The storage data area can store data created according to the use of the device. In addition, the memory 20 may include a high speed random access memory, and may further include a non-volatile memory, for example, at least one disk storage, flash memory or any other non-volatile solid-state memory. In some embodiments, the memory 20 includes memories arranged remote relative to the controller 10. These memories can be connected to the device over the network. Instances of this network include but are not limited to the Internet, Intranet, Local Area Network (LAN), mobile communication network and a combination of them.

The input device 30 is used for receiving input digital or character information and key signals associated with user settings and function control of the device. For example, the input device 30 is an operation panel of the washing machine. The output device 40 may include display equipment such as a display screen or a sound output device such as an alarm device. For example, the output device 40 is an alarm device 5.

Finally, it is should be understood by those skilled in the art that all or part of the processes in the methods described in the above embodiments may be implemented by related hardware executed through computer programs. The computer programs may be stored in a non-transitory computer-readable storage medium. When being executed, the programs may include the processes in the methods described in the above embodiments. The computer-readable storage medium may be a magnetic disk, an optical disk, a read only memory (ROM) or a random access memory (RAM), etc.

Embodiments of the present disclosure provide a device and method for controlling automatic opening and closing of an upper cover of a washing machine, which can solve the problem in which the user is pinched during the opening or closing process of the upper cover and the motor is burnt because of being blocked for a long time, reduce the possibility of accidently pinching the user, and save the force used when the upper cover is opened or closed manually.

What is claimed is:

1. A device for controlling automatic opening and closing of an upper cover of a washing machine, comprising a controller and a detector, wherein the controller is configured to control a motor connected to the upper cover to drive the upper cover to open, close or stop at a current position;

the detector is connected to the controller, the detector is configured to collect a signal indicating an obstacle between the upper cover and a tray or on one side of the upper cover facing away from the tray, and send the signal indicating the obstacle to the controller; and the controller is further configured to receive the signal indicating the obstacle, and determine whether the obstacle between the upper cover and the tray or on the one side of the upper cover facing away from the tray exists according to the signal indicating the obstacle;

when a nonexistence of the obstacle between the upper cover and the tray or on the one side of the upper cover facing away from the tray is determined, control the motor to drive the upper cover to be continuously opened or closed until the upper cover is fully opened or closed; and when an existence of the obstacle between the upper cover and the tray or on the one side of the upper cover facing away from the tray is determined, control the motor to drive the upper cover to stop at a current position or return to an initial position; and after the upper cover stops at the current position or returns to the initial position for a duration T, perform the operations of controlling the motor to drive the upper cover to open or close until receiving the signal indicating the obstacle.

2. The device according to claim 1, wherein the controller is configured to control the motor to rotate clockwise, rotate counterclockwise or stop, to drive the upper cover to open, close or stop at the current position respectively.

3. The device according to claim 2, wherein the signal indicating the obstacle is a current signal of a coil of the motor during the rotation of the motor; wherein the detector is configured to collect the current signal, the controller is configured to receive the current signal, calculate a corresponding current value I, and determine the existence of the obstacle between the upper cover and the tray or on the one side of the upper cover facing away from the tray when the current value I is greater than a preset current value $I_a$.

4. The device according to claim 3, further comprising an alarm device connected to the controller, wherein the alarm device is configured to send an alarm to remind a user to remove the obstacle after the existence of the obstacle between the upper cover and the tray or on the one side of the upper cover facing away from the tray is determined by the controller.

5. The device according to claim 1, further comprising an angle measuring device connected to the controller, wherein when the upper cover is manually opened or closed, the angle measuring device is configured to collect a first angle between the upper cover and the tray in real time and send the first angle to the controller; and the controller is configured to receive the first angle sent from the angle measuring device, determine a second angle at which the upper cover opens or closes according to the first angle, compare the second angle with a preset angle to acquire a comparison result, and determine whether to control the motor to drive the upper cover to open or close automatically according to the comparison result.

6. A method for controlling automatic opening and closing of an upper cover of a washing machine, comprising:

(a) controlling a motor to drive the upper cover to open, close or stop by a controller;

(b) collecting a signal indicating an obstacle between the upper cover and a tray or on one side of the upper cover facing away from the tray by a detector, and sending the signal indicating the obstacle to the controller by the detector;

(c) receiving the signal indicating the obstacle by the controller, determining, by the controller, whether the obstacle between the upper cover and the tray or on the one side of the upper cover facing away from the tray exists according to the signal indicating the obstacle;

(d) when an existence of the obstacle between the upper cover and the tray or on the one side of the upper cover facing away from the tray is determined by controller, controlling, by the controller, the motor to drive the upper cover to stop at a current position or return to an initial position by the controller and performing (a)-(d) after the upper cover stops at the current position or returns to the initial position for a duration T; and (e) when a nonexistence of the obstacle between the upper cover and the tray or on the one side of the upper cover facing away from the tray is determined by the controller, controlling, by the controller, the motor to drive the upper cover to be continuously opened or closed until the upper cover is fully opened or closed.

7. The method according to claim 6, wherein, the collecting the signal comprises the detector collecting a current signal of a coil in the motor during rotation of the motor as the signal indicating the obstacle.

8. The method according to claim 7, wherein, the receiving the signal comprises the controller receiving the current signal and calculating a corresponding current value I, and determining the existence of the obstacle between the upper cover and the tray or on the one side of the upper cover facing away from the tray when the current value I is greater than a preset current value $I_a$.

9. The method according to claim 6, wherein, after the existence of the obstacle between the upper cover and the tray or on the one side of the upper cover facing away from the tray is determined by the controller, the method further comprises: sending an alarm by an alarm device to remind a user to remove the obstacle.

10. The method according to claim 9, wherein before the motor is controlled to drive the upper cover to open or close, the method further comprises: manually opening or closing the upper cover, and collecting a first angle between the upper cover and the tray in real time by an angle measuring device, and sending the first angle to the controller by the angle measuring device; and receiving the first angle sent from the angle measuring device by the controller, determining a second angle at which the upper cover opens or closes according to the first angle, comparing the second angle with a preset angle to acquire a comparison result, and determining whether to control the motor to drive the upper cover to open or close automatically according to the comparison result.

11. The method according to claim 10, further comprising: controlling, by the controller, the motor to drive the upper cover to open or close automatically when the second angle is greater than or equal to the preset angle.

12. The method according to claim 10, wherein the preset angle is in a range of 0°-30°.

13. A washing machine, comprising a device for controlling automatic opening and closing of an upper cover of a washing machine according to claim 1, an upper cover, a motor and a tray, wherein the motor is connected to the upper cover, and the upper cover is connected to the tray.

14. A non-transitory computer-readable storage medium, which is configured to store computer-executable instructions for performing the method for controlling automatic opening and closing of an upper cover of a washing machine according to claim 6.

15. The device according to claim 2, further comprising an angle measuring device connected to the controller.

16. The device according to claim 3, further comprising an angle measuring device connected to the controller.

17. The device according to claim 4, further comprising an angle measuring device connected to the controller.

18. The method according to claim 7, wherein, after the existence of the obstacle between the upper cover and the tray or on the one side of the upper cover facing away from the tray is determined by the controller, the method further comprises: sending an alarm by an alarm device to remind a user to remove the obstacle.

19. The method according to claim 8, wherein, after the existence of the obstacle between the upper cover and the tray or on the one side of the upper cover facing away from the tray is determined by the controller, the method further comprises: sending an alarm by an alarm device to remind a user to remove the obstacle.

20. The method according to claim 11, wherein the preset angle is in a range of 0°-30°.

* * * * *